United States Patent [19]

Johnson

[11] 4,091,649

[45] May 30, 1978

[54] METHOD OF UNCOILING AND STRAIGHTENING STRIP MATERIAL

[75] Inventor: Kenneth C. Johnson, Des Plaines, Ill.

[73] Assignee: F. J. Littell Machine Company, Chicago, Ill.

[21] Appl. No.: 779,162

[22] Filed: Mar. 18, 1977

Related U.S. Application Data

[62] Division of Ser. No. 732,324, Oct. 14, 1976, Pat. No. 4,047,416.

[51] Int. Cl.[2] ..... B21D 1/02

[52] U.S. Cl. ..... 72/183; 226/91; 226/118

[58] Field of Search ..... 72/183, 160, 161, 164, 72/163, 165, 250, 228, 231, 133; 242/78.6–78.8; 226/91, 118

[56] References Cited

U.S. PATENT DOCUMENTS

| | | | |
|---|---|---|---|
| 2,662,271 | 12/1953 | Greenberger | 226/118 X |
| 2,887,147 | 5/1959 | Ficht | 72/165 X |
| 3,022,812 | 2/1962 | Groll | 72/160 X |
| 3,187,530 | 6/1965 | Ranney | 72/183 X |
| 3,715,903 | 2/1973 | Huber et al. | 72/183 |
| 3,722,251 | 3/1976 | Withrow | 72/379 |
| 3,817,067 | 6/1974 | Voorehes | 72/12 |

*Primary Examiner*—Milton S. Mehr
*Attorney, Agent, or Firm*—Russell H. Clark

[57] ABSTRACT

Certain steps in the present method of uncoiling and straightening strip material require that the pivotally mounted straightening machine have an inclined position as when operating on rather heavy and thick material. However when operating on thin strip material the pivotal straightening machine is horizontally positioned and substantially the same method steps are performed in passing the strip material to an accumulation pit. Also the coil is contained during operation to prevent uncontrolled expansion of the internal convolutions and stripping of the initial convolutions from the rotating coil and bending the same in a direction reverse to the curvature when on the coil is also contemplated by the method disclosed.

2 Claims, 5 Drawing Figures

METHOD OF UNCOILING AND STRAIGHTENING STRIP MATERIAL

This application is a divisional of my co-pending application Ser. No. 732,324 filed Oct. 14, 1976 and entitled Uncoiling And Straightening Apparatus For Strip Material, now Patent No. 4,047,416 granted September 13, 1977.

The invention relates to a method of uncoiling and straightening strip material and has reference in particular to a method for uncoiling metal strip material from a coil, straightening said uncoiled material and then feeding the straightened material to a press for other operations such as forming, cutting or punching.

The method steps of the present invention can only be performed by apparatus wherein the feeding and straightening machine is mounted on a horizontal axis for pivotal movement into and from horizontal and downwardly inclined positions. The method steps of the invention also require a collapsible table which is located over the accumulation pit and which extends between the exit and of the straightening machine and the feed rollers of the forming, cutting or punching press. Apparatus of this type and character as specified is shown in the parent application and the main objective of this invention is to more fully make known and particularly apply the several method steps to the respective pieces of equipment comprising the unique and novel combinations that have been disclosed.

One unique combination having certain new and improved method steps in its operation resides in supporting a rotatable coil of metal stock in an elevated position and in applying pressure to the coil at a diametrically opposite area from its support so as to contain the convolutions of the coil while the same may be rotating for unwinding purposes.

Another object of the invention based on the foregoing is to provide a method wherein the pressure is applied to the coil for the full width thereof from one side of the other.

Another feature of the present method resides in a stripping operation on the coil which is rotating to strip the outer convolution from the same and direct the material so stripped towards the straightening machine. The operation is accomplished by a stripping finger mounted on an apron and powered towards the coil by an hydraulic cylinder, the apron and thus the finger being supported for pivotal movement on the same horizontal axis as the straightening machine.

A further objective of the invention is to straighten strip material by passing it through a straightening machine capable of pivotal movement whereby to shorten the length of the accumulation pit and save factory space. A horizontal table having collapsible table sections is located over the accumulation pit and when thick material is being processed, the straightening machine is inclined dpwnwardly and the table sections are collapsed so that the strip material can leave the accumulation pit without interference. However when the straightening machine is positioned horizontally, as for initial threading of the strip material, the strip is directed over the horizontally positioned table sections to the rolls of the press. Thus considerable factory space is saved by locating the collapsible table over the accumulation pit and further an improvement in operation is obtained by reason of the pivotal capability of the straightening machine.

With these and other objects in view, the invention may consist of certain novel features in the method of operation as will be more fully described and particularly pointed out in the drawings, specification and claims appended hereto.

In the drawings which illustrate one embodiment of an uncoiling and straightening machine to which the method applies, and wherein like reference characters designate like parts, FIG. 1 is a side elevational view showing the complete assembly of an uncoiling and straightening machine to which the method steps of the invention apply, with some parts being shown in dual positions;

Figure 4:
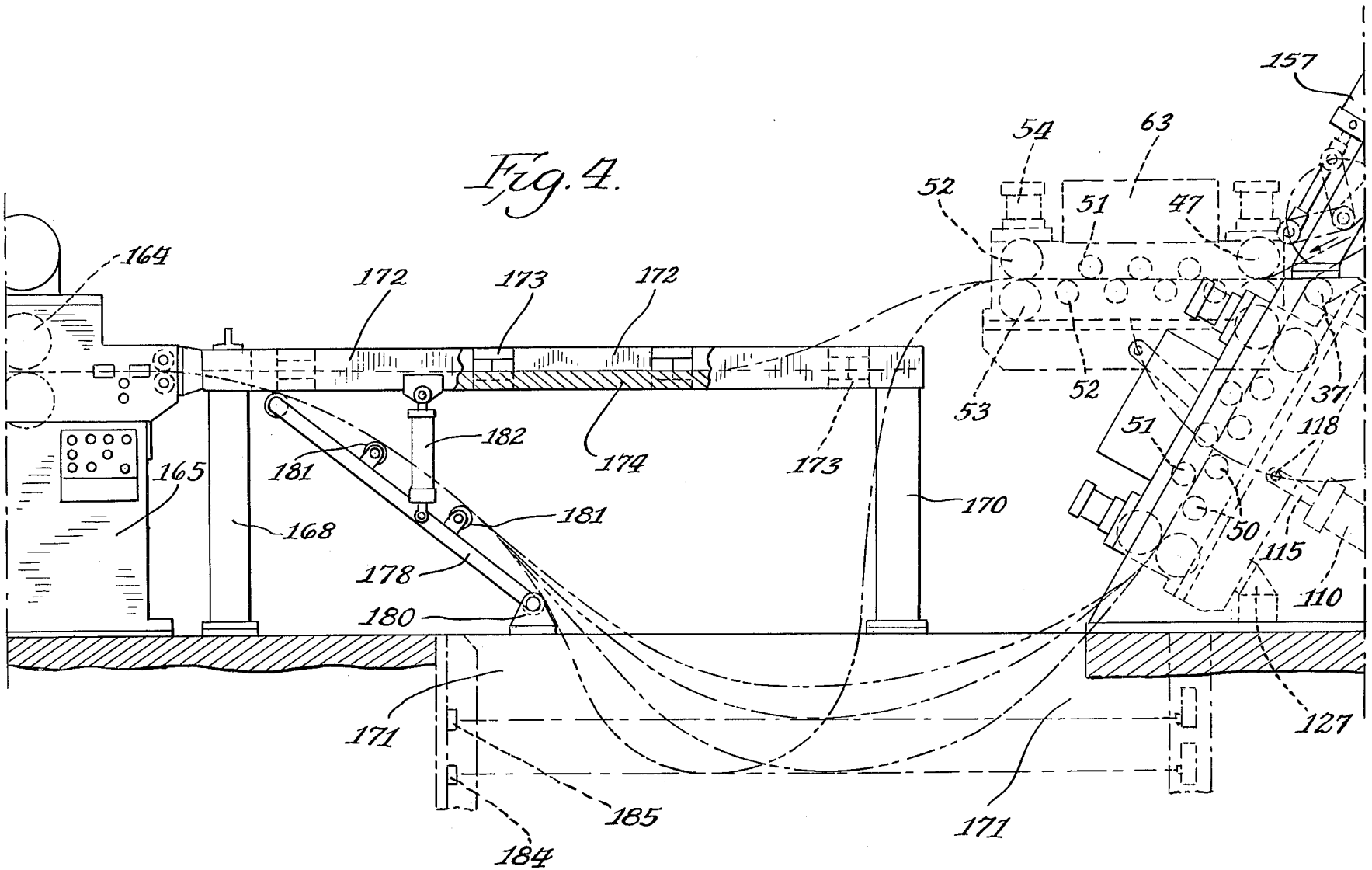
Figure 5:
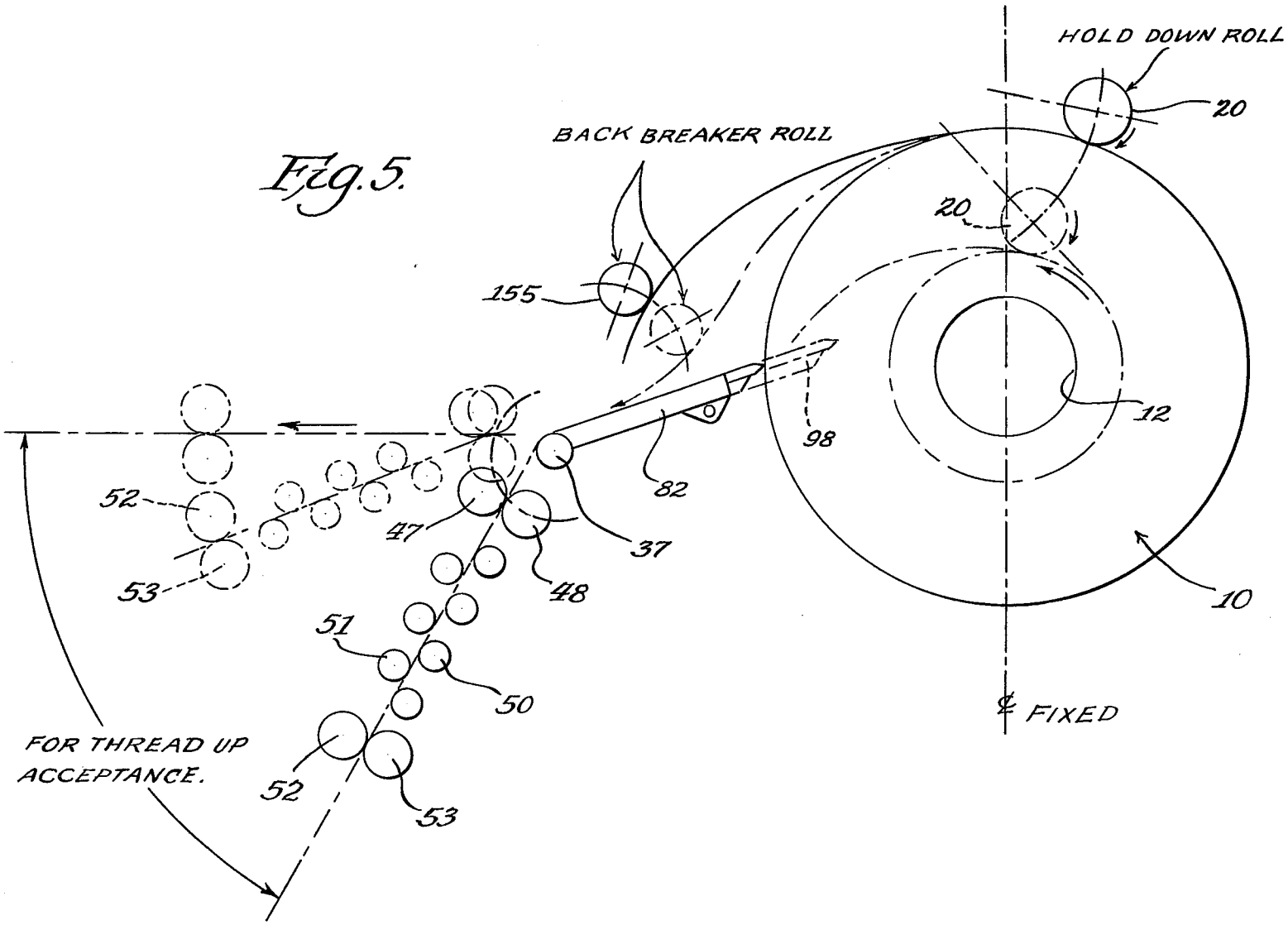

FIG. 4 is a side elevational view illustrating the ability of the pivoted straightening machine to handle thin material and also heavy thich material when feeding to the accumulation pit and further illustrating the action of the collapsible table as regards both thin and thick strip material, and FIG. 5 is a view illustrating in a diagrammatical manner the processing of the material including its unwinding action, its striping action and the straightening operation performed on the material with the straightening machine in its various positions.

Figure 1:
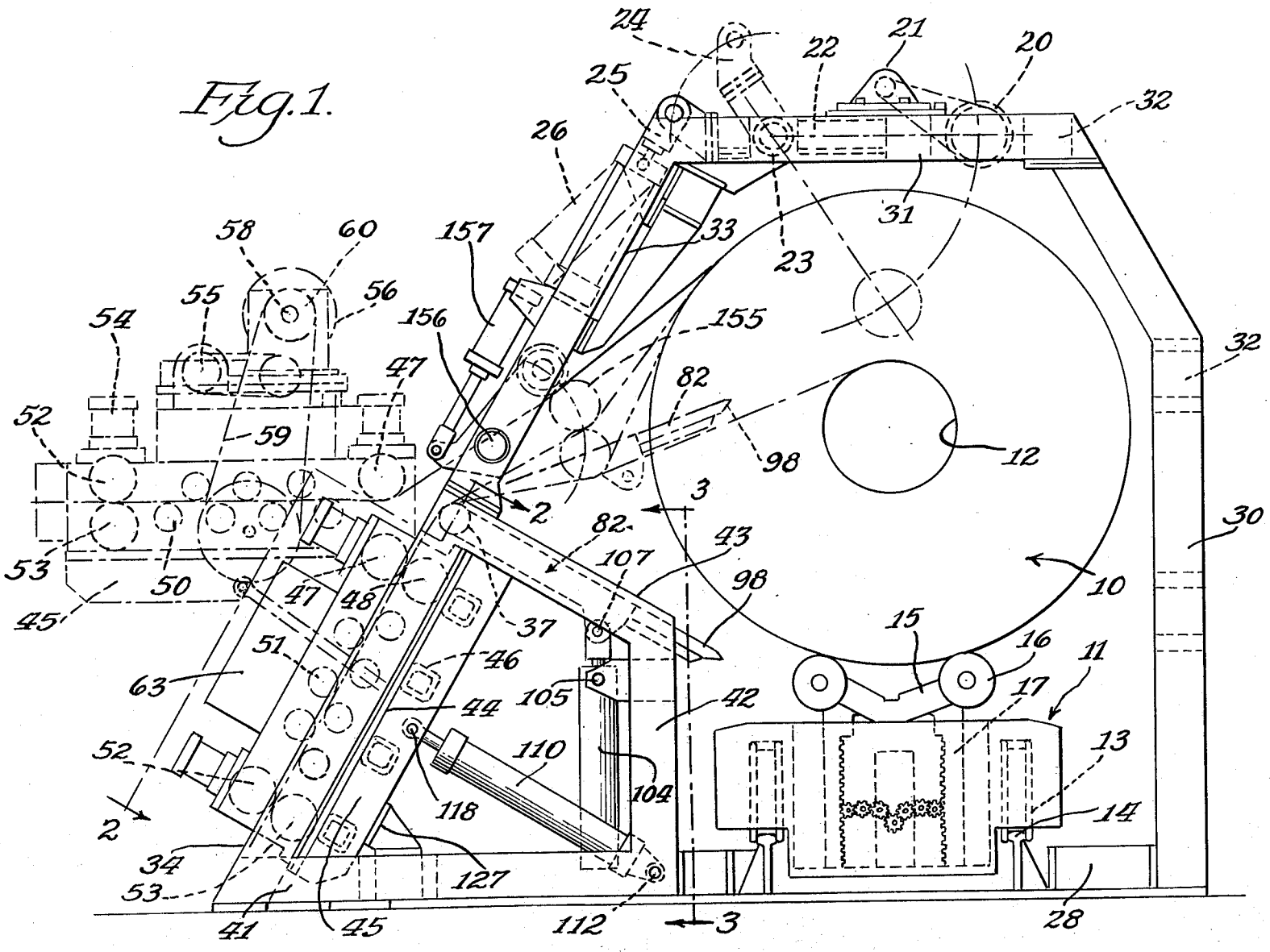

FIG. 1 shows a heavy metal coil 10 in supported position over a loading car generally identified by numeral 11. So that the coil can be rotated for unwinding purposes, additional supporting and rotatable means must be provided all as well known in the art, and for this purpose a reel of the cantilever trunnion type may be employed such as shown in the Littell U.S. Pat. No. 2,598,398 granted May 27, 1952. The radially expanding arms of the trunnion enter the central core opening 12 of the coil and the coil is thus supported within the metal frame to be described and the coil can be rotated, held against rotation, or rotated in a reverse direction. The loading car 11 for the coil 10 is conveniently supported by the car wheels 13 for rolling movement on the rails 14 and in addition thereto the saddle 15 having the idler rollers 16 can be elevated and lowered by the gear and rack mechanism 17 which may be motor driven. By means of the said mechanism the saddle can be moved in an upward direction and thus pressure can be applied to a coil forcing the coil into contact with the full width hold-down roller 20. FIG. 1 shows several pivotal positions of the hold-down roller 20.

The roller is powered by the motor 21 to cause the same to rotate. The pivot shaft 23 carries the arms 22 for the motorized hold-down roller. The arms each have a rear extension 24 and which is connected to the clevis 25 forming part of the piston rod member of the pivotally supported power cylinder 26. When desired the power cylinder can be energized to force the hold-down roller 20 into pressure contact with the coil. By applying top pressure to the coil better control of the coil can be obtained. It may be mentioned that the internal convolutions of the coil are under enormous stresses tending to cause the coil to explode after the encircling bands are cut. The pressure control as above described is important to the operator and its helps to insure his safety.

The operator is further protected by the enclosing frame structure for the coil and which may be generally termed an "A" frame. Base members 28 are located adjacent the rails 14 and on the right side as shown in FIG. 1 the rear supporting frames 30 connect therewith. Two such frames are employed, one on each side of the coil, and at their upper end each frame piece is joined by a top frame 31 and by a transverse connecting frame piece 32. The frames 31 provide a support for the pivot shaft 23 which carries the arms 22 for the motorized hols-down roller 20. The arms 22 each have a rear extension 24 and which is connected to the clevis 25 forming part of the piston rod of the pivotally supported power cylinder 26. The said top frame 31 are also joined by the front sloping frame members 33. At this corner of the frame structure transverse connecting members such as 32 are also employed in addition to those employed for the members 30 to thus form a rigid and strong supporting frame structure.

Figure 2:
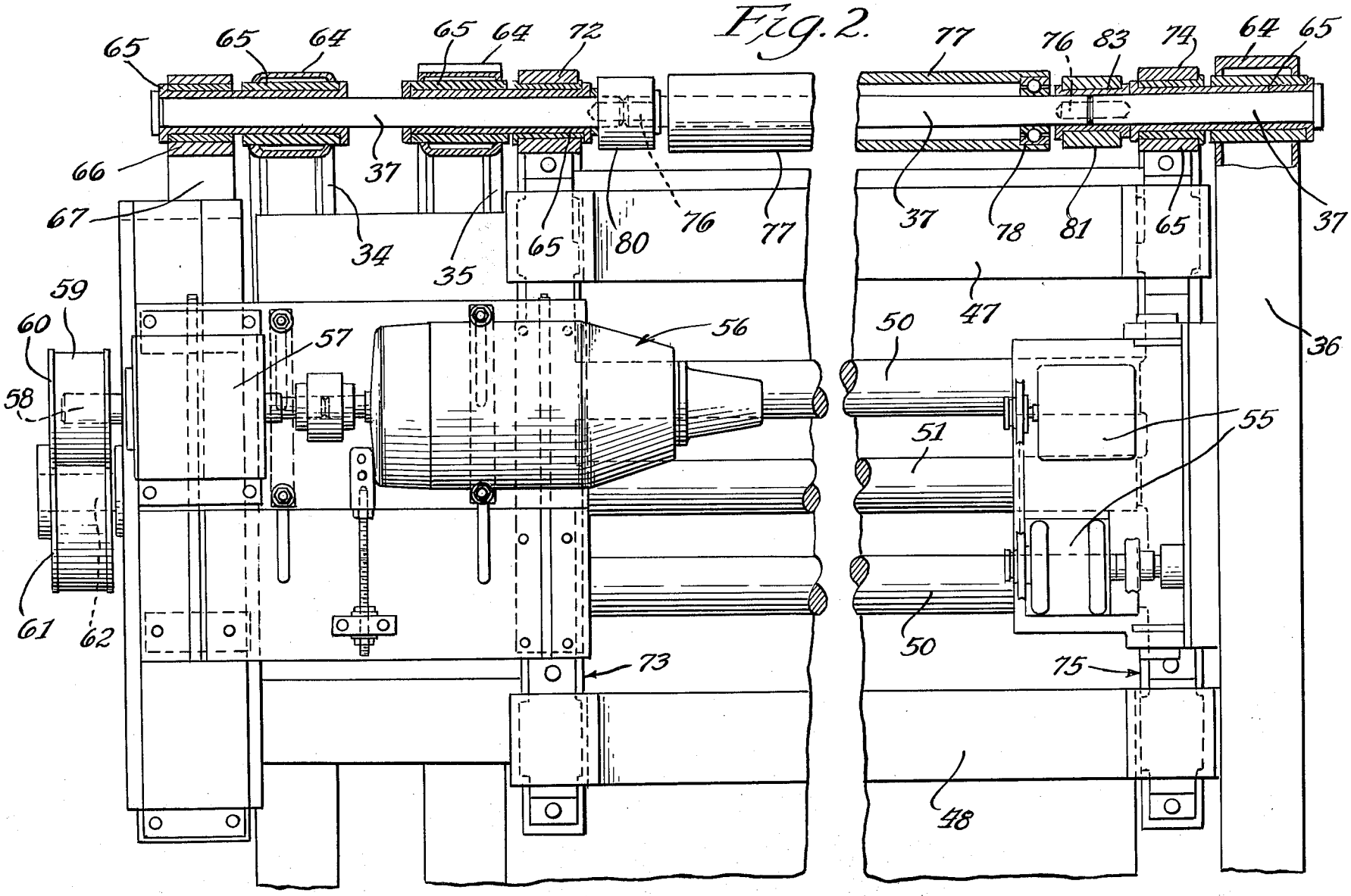
FIG. 2 is an elevational view, with parts in section, taken substantially on line 2—2 of FIG. 1 and showing in detail the structure provided by the supporting frames for pivotally mounting the straightening machine and additionally showing certain features of said machine.
Figure 3:
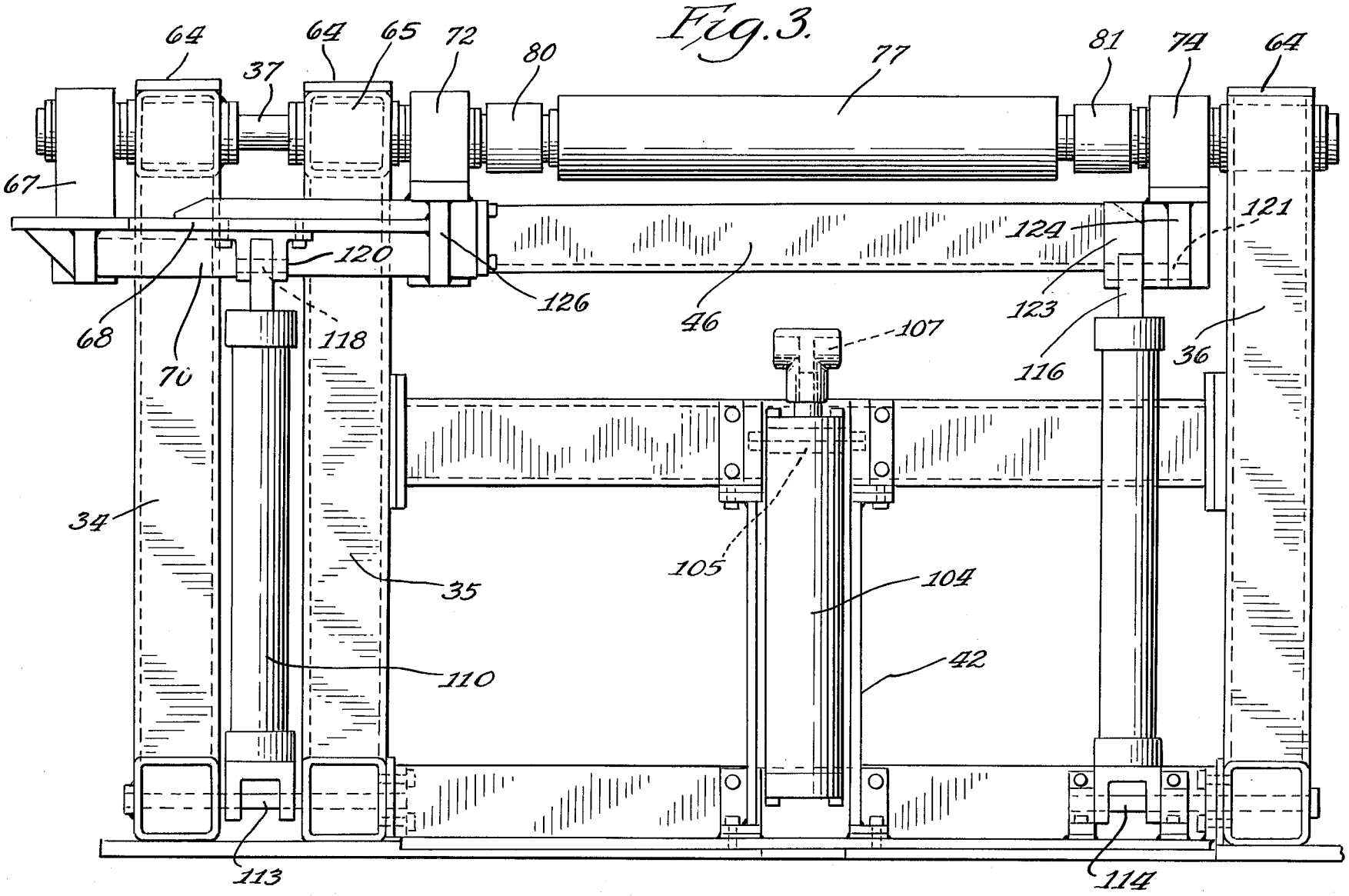
FIG. 3 is a partial vertical view taken substantially on line 3—3 of FIG. 1 and showing the base side of the straightening machine together with the pivoting structure for said machine and the tubular roller mounted for rotation on the same axis, said view additionally showing the power means for respectively oscillating the straightening machine and the stripper finger apron.

Said front diagonally sloping members 33 suitably connect immediately above the axis 37 with similar members 34, 35 and 36 of a secondary frame structure as shown in FIGS. 2 and 3. Said frame supports the straightening and feeding machine 38 for pivotal movement on said horizontal axis 37 and the three main supporting members 34, 35 and 36 are respectively joined together and to bottom member 41 of said secondary frame structure which also includes the connected uprights 42 and the top connecting member 43. Whereas frame elements 30, 31 and 33 are duplicated on each side of the structure, the three main supports are provided to insure a rugged, strong and durable frame for pivotally mounting and supporting the straigthening machine 38.

The said machine is conventional in structure and in operation. A more specific disclosure may be found in U.S. Pat. No. 3,289,448 granted to Chester Wiig on Dec. 6, 1965. For purposes of the invention the straightening machine is mounted on a base 44 consisting of side frame 45 and connecting tubular members 46. At the entrance end, as regards the strip material, two coacting pinch rolls 47 and 48 are suitably journalled by the machine and beyond said pinch rolls the machine journalls the lower straightening rolls 50 and the upper bodily movable straightening rolls 51. The bite of the rear pinch rolls and also that of the forward pinch rolls 52 and 53 can be adjusted by means located within the housing members 54. Only the lower rolls 50 rotate. They do not move bodily in a vertical direction as do the upper rolls 51. This movement of the upper rolls is possible since their journal bearings are carried by bearing blocks mounted for movement towards and from their co-acting lower rolls. The adjustment of the upper straightening rolls to control the action of the machine on the strip material is controlled by mechanism 55 generally shown in FIG. 1. The numeral 56 indicates the driving motor of the straightening machine 38 which has operative driving relation with the speed reducer 57 providing the drive shaft 58. The belt 59 passes around pulley 60 and around the pulley 61 whereby to drive the gear shaft 62 from said drive motor 56. The gears which operatively connect all the straightening rolls and also the pinch rolls with the shaft 62 are housed within the gear box 63, FIG. 1.

As diagrammatically illustrated in FIG. 5, the straightening machine 38 is pivotally supported for movement to and from horizontal and inclined positions on the horizontal axis previously designated by numeral 37. Referring more particularly to FIG. 3, the horizontal shaft 37, which forms said axis, is journalled in each of the frame supports namely 34, 35 and 36. The support 34 at its upper end receives the journalling member 64 and this in turn receives the bushing 65 through which the left hand section of shaft 37 extends. The support 67 near its lower end has the plate section 68 secured thereto, FIG. 3, and which is reinforced by the side frame part 70. The plate section and side frame part are secured to each other and they extend to the right for securement to the rib structure 126 to be subsequently referred to and which is secured to the journalling part 72. The shaft 73 extends from the support 34 to the left and passes through the journalling section 66 of said frame part 67. In this manner the left hand portion of the straightening machine is pivotally mounted on shaft 37. This left hand portion of the machine provides the support for the motor 56 and for the gear box 63 and other driving and regulating means of the machine. In a similar manner the frame support 35 at its upper end receives a journalling member 64 which in turn receives a bushing 65. The bushing extends into and through the journalling section 72. Also the left section of the shaft 37 passes through the bushing and into and through the journalling section 72 of the left side frame part 73 of the machine. Again and in a similar manner the right hand frame support 36 at its upper end receives a journalling member 64 which in turn receives a bushing 65, and this structure in turn supports the right hand section of the shaft 37. The bushing 65 extends to the left to pass through the journalling section 74 provided by the right hand frame member 75 of the straightening machine. The bushing and also the shaft extend a short distance beyond in a left hand direction. Accordingly the frame structure of the straightening machine is supported and pivotally mounted on the shaft 37 by the journalling members 66, 72 and 74 are provided by the side frames of the machine, namely 67, 73 and 75. Whereas the left side 73 is pivotally mounted adjacent frame suppport 35, the right side frame 75 is pivotally mounted adjacent the frame support 36.

Although the shaft 37 is shown in FIG. 4 as comprising three sections, it could of course be a single piece unit. The combination of sections which are joined by dowel pins 76 helps to facilitate assembly of the several parts including the roller 77. The roller is mounted on the central section of shaft 37 by means of the roller bearings 78. On each side outwardly of the roller the shaft carries the journalling sections 80 and 81 of the stripping finger apron 82 shown in dual positions in FIG. 1. Each journalling section for the apron is provided with the conventional bushing 83 and the structure enables the apron to have pivotal movement on the same shaft which pivotally supports the straightening machine and which also carries the rotatable roller 77. The stripping finger 96 is carried by the apron 82 and said finger is capable of movement in a forward direction for stripping purposes and in a rearward direction to locate the finger in an inoperative position. The apron is powered for pivotal movement on the pivot shaft 37 by the power cylinder 104 as shown in FIG. 1. The cylinder is pivotally supported at 105 and the piston rod 106 of the cylinder connects with the under side of the apron at 107, see FIGS. 1 and 3. Thus the apron can be elevated so as to position the stripping finger in proper relation for stripping action on the coil. When the straightening machine is in an inclined position, the stripping finger can then be retracted and the apron lowered into an inoperative position since the finger is not needed after a threading action has been completed.

Power cylinders are also provided for the straightening machine 38 to move the machine into and from its horizontal and inclined positions. The cylinders are preferably of the hydraulic type and are generally designated by numerals 110 and 111 as shown in FIG. 3. The cylinder end of each power device is pivoted at 112 to the "A" frame structure, the pivot members 113 and 114 being shown in FIG. 3. Said cylinders each including a piston which moves within the cylinder and to which is fixed a piston rod, 115 for cylinder 110 and 116 for cylinder 111. Piston rod 115 is pivotally secured by pivot pin 118 to the connection 120 having securement to and depending from the base frame part 70 of the straightening machine and which is additionally reinforced by the rib structure 126. The piston rod 116 is likewise pivotally connected to the straightening machine by the pivot pin 121 mounted in the frame part 123 provided by the base structure on which the machine is mounted and said pivot pin 121 extends into and is additionally anchored by the rib 124 depending from the journalling part 74 of the right hand frame part 75 of the machine.

The power cylinders anchored to the frame structure "A" at their cylinder ends and having their piston rods pivotally connected to the base of the pivotally mounted straightening machine provide effective and efficient power means for raising and lowering the straightening machine. Each cylinder has valved ports on respective sides of the piston for the entrance and exit of the high pressure hydraulic medium. When the hydraulic medium is admitted to the space below the pistons, the piston rods are extended to elevate the straightening machine, the maximum elevated position being of course the horizontal position. When the medium is exhausted from the space below the piston and admitted to the space behind the piston, the piston rod will move down under control to lower the machine into any desired inclined position. When the maximum inclined positiom is reached the machine is caused to contact and rest on the pad 127. The straightening machine can be held in contact with the pad by closing the valved ports thus trapping the hydraulic medium on both sides of the pistons. Also the machine can be held in a desired inclined position by a similar closing of the valved ports.

As shown in FIG. 1, a back-breaker roller 155 is employed for bending the metal strip material reversely to its curvature which it assumes when on the coil. The back-breaker roller contacts the strip as its passes over the stripping apron 82. A reverse bending of the material facilitate its movement in a substantially flattened condition into the rear pinch rolls 47 and 48. The roller 155 is carried by a bracket pivoted at 156 and powered into and from operating positions by the power cylinder 157.

As illustrated in FIG. 5, the strip material is unwound from a coil passed under the back-breaker roller and into the rear pinch rolls 47 and 48 of the straightening machine. In so doing the strip material passes over, and when inclined for operation on thick material, the same has contact with the roller 77. For initial threading of thin strip material the straightening machine may be positioned horizontally and if necessary the back-breaker roller is employed to facilitate the threading operation. However for thread up acceptance as regards thick material the machine is preferably inclined and such inclination may vary as shown in FIG. 5. Considerable leeway is thus provided in the downwardly inclined positions of the machine for receiving and operating on the strip material and which are positions that are favorable for the material considering the angle at which it comes off the coil.

When the straightening machine is elevated into a horizontal position, the strip material will travel in a horizontal direction whereby to pass over the table as shown in FIG. 4. Said table is provided for supporting and directing the length of strip material into the feeding rolls 164 of the feeder 165 and in accordance with the invention the table is located over the accumulation pit 171. The table includes the upright posts 168 and 170 positioned in spaced relation transversely as regards the movement of the strip and extending upwards from the floor which is recessed to provide the accumulation pit 171. The horizontal rails 172 form the sides of the table and which are suitably spaced to accommodate the strip material. The side rails have the hinges 173 on their inside surfaces and the hinges in turn pivotally support the table sections 174 and 175 respectively. The table sections of course extend for the length of the side rails and when the same are horizontally positioned the table is complete. However, when the table sections are dropped down to hang vertically, then the table is collapsed and the strip material can pass between the same without any interference from the table.

The table is conveniently located over the accumulation pit 171 which has been materially reduced in length by reason of the pivoted capability of the straightening machine. As shown in FIG. 4, the machine can be positioned horizontally when operating on thin strip material which can easily bend downwardly from the exit pinch rolls 52 and 53 into the accumulation pit. However thick heavy strips cannot bend to sharply and the pit would have to be extended to the left were it not for the fact that the straightening machine is pivotal and the same can be inclined and in an inclined position the thick material can be easily fed to the accumulation pit, in fact, the angle of the strip is a natural since it accommodates itself to the pit.

In both horizontal and inclined positions the straightening machine feeds into the pit which permits a loop to accumulate before feeding to the rolls 164. The feeding is facilitated by the auxiliary table 178 which is pivoted at 180, the table having the rollers 181 which extend for the full width of the strip. The auxiliary table is raised and lowered by the power cylinder 182. Electronic devices located below the floor level and in line with the loop, control the speed of the straightening machine with respect to the feeding rolls of the press. When the loop exceeds its maximum size then the electronic device 184 is activated to slow down the feeding rate of the machine and when the feeding loop exceeds its minimum size the electronic device 185 is activated to speed up the action of the machine.

I claim:

1. In a method of threading and dispensing strip material which is in the form of a coil, the steps which include supporting the coil in a raised position for rotation, unwinding the strip material from the coil and directing the same downwardly at an inclined angle with respect to the horizontal, passing the material through a pivotally supported straightening machine which for the purpose is also downwardly inclined at an angle substantially the same as the angle which the material assumes as its travels from the coil to the straightening machine, the passage of the material through the straightening machine having the effect of removing the curvature which the strip assumes while on the coil and for otherwise straightening the material, delivering the strip material as its exits from the inclined straightening machine to an accumulation pit located slightly below and relatively near the exit end, said accumulation pit producing a loop of excess material in advance of the feeding rolls of the press to which the material is being fed, and finally passing the material of said loop, as said material moves from the said pit to the feed rolls of the press, between collapsed table sections of a collapsible table located substantially over the accumulation pit.

2. In a method of threading and dispensing strip material which is in the form of a coil, the steps which include supporting the coil in a raised position for rotation, unwinding the strip material from the coil and directing the same to and passing the material through a pivotally supported straightening machine which is positioned horizontally for receiving the strip material, supporting the material as its exits from the machine on horizontally positioned table sections of a collapsible table located substantially over an accumulation pit, continuing the support of the strip material on said table sections while the material travels forwardly for threading between the feed rolls of a press, moving the horizontally positioned straightening machine into an inclined position after the material is under the control of the press feed rolls, directing the strip material as its exits from the inclined straightening machine to said accumulation pit for travel through the pit to produce a loop of excess material, and finally releasing the table sections so that they depend vertically and do not interfere with the movement of the strip material through the accumulation pit on its way to the feed rolls of the press.

* * * * *